US006694986B2

(12) United States Patent
Alexander

(10) Patent No.: US 6,694,986 B2
(45) **Date of Patent: *Feb. 24, 2004**

(54) SELF-CONTAINED APPLICATOR FOR APPLYING FLUID

(76) Inventor: Larry Rush Alexander, 2306 Central St., Evanston, IL (US) 60201

( * ) Notice: Subject to any disclaimer, the term of this patent is extended or adjusted under 35 U.S.C. 154(b) by 0 days.

This patent is subject to a terminal disclaimer.

(21) Appl. No.: 10/152,149

(22) Filed: May 21, 2002

(65) Prior Publication Data

US 2003/0015210 A1 Jan. 23, 2003

Related U.S. Application Data

(63) Continuation-in-part of application No. 09/566,538, filed on May 8, 2000, now Pat. No. 6,390,101.

(51) Int. Cl.[7] ..... A45D 24/22
(52) U.S. Cl. ..... 132/116; 132/112; 132/115
(58) Field of Search ..... 132/116, 115, 132/112, 148, 219; 401/175, 179, 174, 171, 172, 173, 176

(56) References Cited

U.S. PATENT DOCUMENTS 2,571,226 A * 10/1951 Fabis ..... 132/148
3,690,331 A * 9/1972 Messer ..... 132/148
4,122,845 A * 10/1978 Stouffer et al. ..... 128/66
4,934,388 A * 6/1990 Gibbs ..... 132/116
5,996,850 A * 12/1999 Morali et al. ..... 222/173
6,210,061 B1 * 4/2001 Johnson ..... 401/175
6,390,101 B1 * 5/2002 Alexander ..... 132/116
6,450,716 B1 * 9/2002 Szekely ..... 401/79

* cited by examiner

*Primary Examiner*—John J. Wilson
*Assistant Examiner*—Robyn Kieu Doan
(74) *Attorney, Agent, or Firm*—Scott P. McBride

(57) ABSTRACT

An apparatus for applying a fluid to hair is provided. The apparatus includes a reservoir for containing a fluid, sidewalls for defining the reservoir. The sidewalls form an elongate curvilinear cavity along an interior surface and forming an exterior surface, wherein the cavity includes the reservoir and having a top portion and a bottom portion and the cavity having a longitudinal axis. The applicator also includes a top endwall located at the top portion of the sidewalls and the endwall includes an elongate cavity for dispensing a fluid. A flexible lip is located adjacent the cavity for assistance in dispensing a fluid from the elongate cavity is also included in the applicator. The applicator includes a movable bottom endwall for containing the fluid within the reservoir and advancing fluid and a rotatable smoothing rod attached to the exterior surface of the sidewalls.

10 Claims, 9 Drawing Sheets

SELF-CONTAINED APPLICATOR FOR APPLYING FLUID

RELATED APPLICATIONS

This is a continuation-in-part of application Ser. No. 09/566,538, filed May 8, 2000, U.S. Pat. No. 6,390,101.

FEDERALLY SPONSORED RESEARCH OR DEVELOPMENT

BACKGROUND OF THE INVENTION

The present invention relates to devices for applying a fluid, and in particular to devices for applying fluid to hair.

In the past, there has been a great need applicators for applying fluid to hair. For example, many people desire to have their hair straightened. One fluid used for straightening hair is Sodium Hydroxide, or lye. When applying hair straightening fluids (commonly called "relaxers") to the hair, the hairdresser applies relaxer one section of the hair at a time and uses his fingers or the backside of a brush to smooth the hair. Due to the chemicals in the relaxer and the smoothing technique, the hair thus becomes straightened. This procedure is desirable for people with curly hair who wish to have straight hair. The procedure is particularly desirable for people with ethnic or racial backgrounds having very curly hair, for example African-Americans.

While other applicators exist, there exists a need for a self-contained applicator with a well-controlled dispensing slot and an apparatus for smoothing integral with the applicator. Moreover, it is desirable to have an applicator that has the capability of being connected to several different sizes of combs (for varying thicknesses of hair). For example, different types of hair have varying thicknesses of hair, such as round-celled hair (straight), oval shaped hair (wavy) and flat cell hair (curly). Different combs are desirable to be used with these varied thicknesses.

BRIEF SUMMARY OF THE INVENTION

It is an object of the present invention to provide an improved applicator for applying relaxer or other fluids to hair.

It is another objection of the invention to provide a self-contained applicator.

It is a further object of the invention to provide an applicator capable of both applying and smoothing a fluid onto hair.

In one embodiment, the apparatus includes a reservoir for containing a fluid, sidewalls defining the reservoir, the sidewalls forming an elongate curvilinear cavity along an interior surface and forming an exterior surface. The cavity includes the reservoir and has a top portion and a bottom portion and the cavity also has a longitudinal axis. The applicator also includes a top endwall located at the top portion of the sidewalls, wherein the endwall includes an elongate cavity for dispensing a fluid. A flexible lip is located adjacent the cavity for assistance in dispensing a fluid from the elongate cavity is also included in the applicator. The applicator also includes a movable bottom endwall for containing the fluid within the reservoir and advancing fluid and a rotatable smoothing rod attached to the exterior surface of the sidewalls.

DETAILED DESCRIPTION OF THE INVENTION

Figure 1:
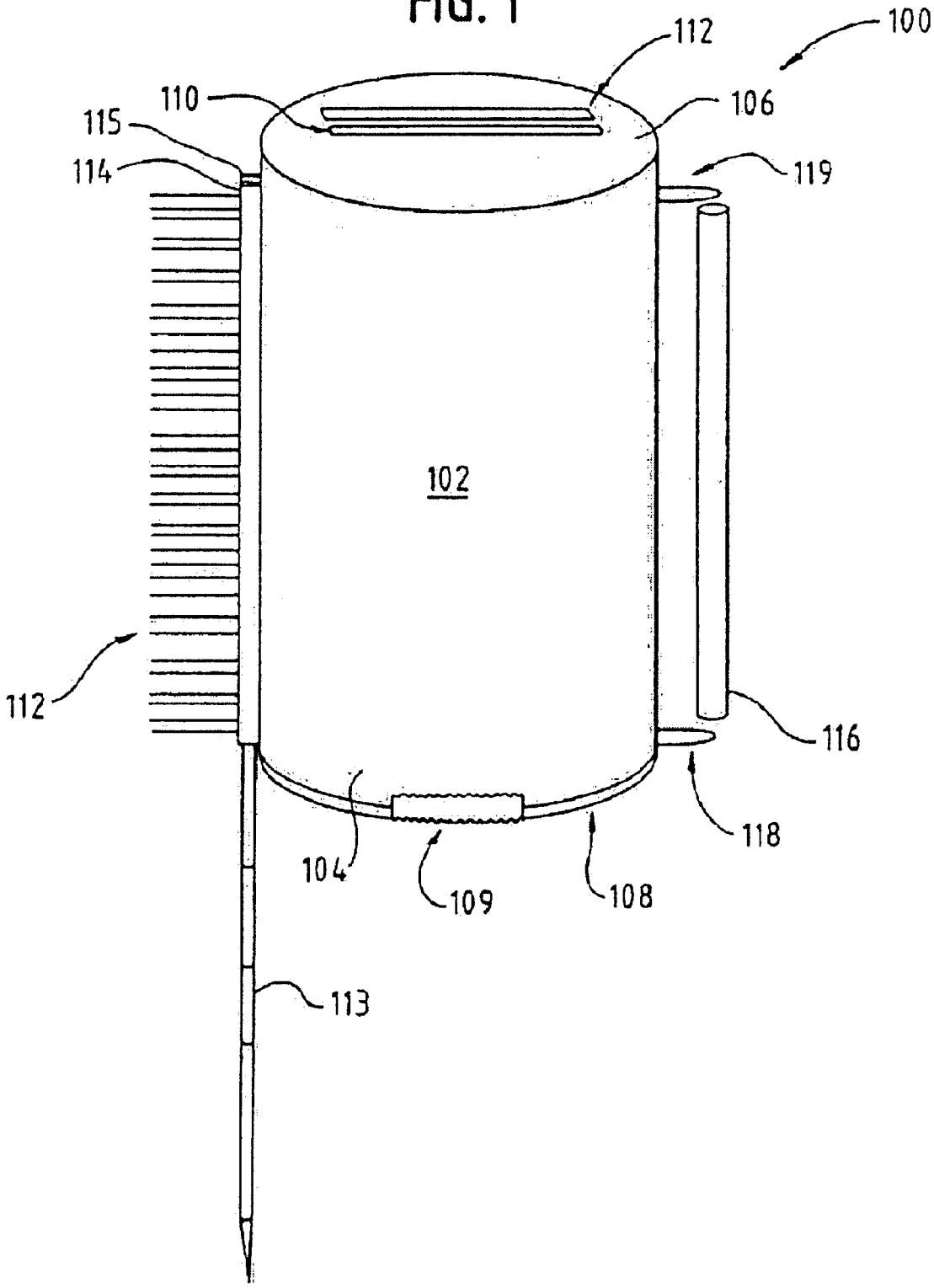
FIG. 1 is a side view of an applicator according to a particular embodiment of the invention.

Referring to FIG. 1, the preferred applicator 100 is shown. The applicator 100 includes a body 102 having sidewalls 104, a dispensing end 106 and a non-dispensing end 108. A driver 109 is located adjacent the non-dispensing end 108. The top surface 106 includes an elongated slot out 110 and a lip 112 adjacent the slot 110, protruding from the dispensing end 106. The applicator 100 also includes a comb or brush 112 having a rattail 113. The comb 112 is secured to the applicator 100 by two retaining tracks 114, 115. The preferred applicator further includes a roller 116 attached to the applicator using two similarly constructed supports 118.

In the preferred embodiment of FIG. 1, the sidewalls 102 form an elongate curvilinear-shaped object with an oval cross-section. In this illustrated embodiment, the sidewalls 102 actually form one continuous wall extending the perimeter of the applicator. The interior of the applicator 100, and thus inside the sidewalls 102, contains the fluid sought to be dispensed from the slot 110. Attached to the sidewall 102 of the preferred applicator 100 are two supports 118, 119 for securing a smoothing rod 116 to the applicator 100. The function of the smoothing rod 116 will be further discussed below. Attached to the other side of the sidewall 102 in the preferred embodiment are vertically aligned tracks 114, 115 for securing a comb or brush 112 to the applicator 100. The location of the tracks 114, 115 is preferably opposite the supports 118, 119 and smoothing rod 116 in order to allow free movement of the rod 116 and freedom to use the comb 112 without interference. A lip 112 is preferably attached to the top surface 106 of the applicator 100. The lip 112 is located adjacent the dispensing slot 110 for reasons that will be further discussed below.

The dispensing slot 110 is elongated so as to permit the fluid retained within the applicator 100 to be dispensed in a wide path. The lip 112 then assists in spreading the fluid dispensed from the slot 110 uniformly. For example, as fluid is forced out of the slot 110, as will be further discussed below, the fluid advances onto the lip 112 and is ideally spread evenly across the hair across which the lip 112 and slot 110 move. In alternative embodiments shown in FIGS.

3*a* and 3*b*, brush bristles 302 or teeth 304 may alternatively be attached adjacent the dispensing slot 110. Bristles 302 may be particularly desirable if bleach or hair color is being applied and teeth 304 may be desirable for use with hair gel. In any event, the slot 110 and structure for assisting in applying the fluid to the hair is preferably located on the dispensing end 106 (which is preferably part of a removable cap), rather than the sidewalls 102. Having this structure on the dispensing end permits the applicator 100 to be used with multiple endcaps, each containing the different structure, such that one applicator may be used for applying several different fluids.

The dispensing end 106 is preferably convex in shape so that the dispensing slot 110 is centrally located at the highest spot on the end 106 and the lip 112 is adjacent the slot. The convex shape assists the user in applying the fluid, for example relaxer, to the head because it permits the user to place the curved end 106 onto the hair, allowing a slight separation of the slot 110 from the scalp. The separation is desirable because of the damage relaxer can do if placed directly onto the scalp. In an alternative embodiment, the applicator 100 includes two nobs 306, which are raised with respect to the dispensing end 106 (as shown in FIG. 3*a*), to achieve separation between the slot 110 and the hair.

The rod 116 is secured to the applicator 100 by supports 118, 119 and preferably extends vertically along the sidewall 102. The rod 116 is secured by the supports 118, 119 such that it is free to spin about its axis. As a result, the user may roll the smoothing rod along the hair after the fluid has been applied to the hair. When straightening hair, for example, this has the desired result of permitting the scalp to be used as the "ironing board" for the hair to be pressed against. This is a significant improvement over the present method in which the user straightens or flattens the hair using his or her thumbs or the backside of a brush.

Another desired feature of the applicator 100 is the telescoping rattail, or parting wand, 113 extending from the comb 112 or non-dispensing end 108 of the applicator 100. The rattail or parting wand 113 is used to part hair, for example to separate different sections of hair for relaxer to be applied to the separate portions. The telescoping feature permits the wand 113 to be placed out of the way when a fluid, such as relaxer, is being applied to the hair, and to be extended only when needed. The telescoping feature also permits the wand to be extended to differing lengths, thereby adapting to the user's preference.

Figure 2:
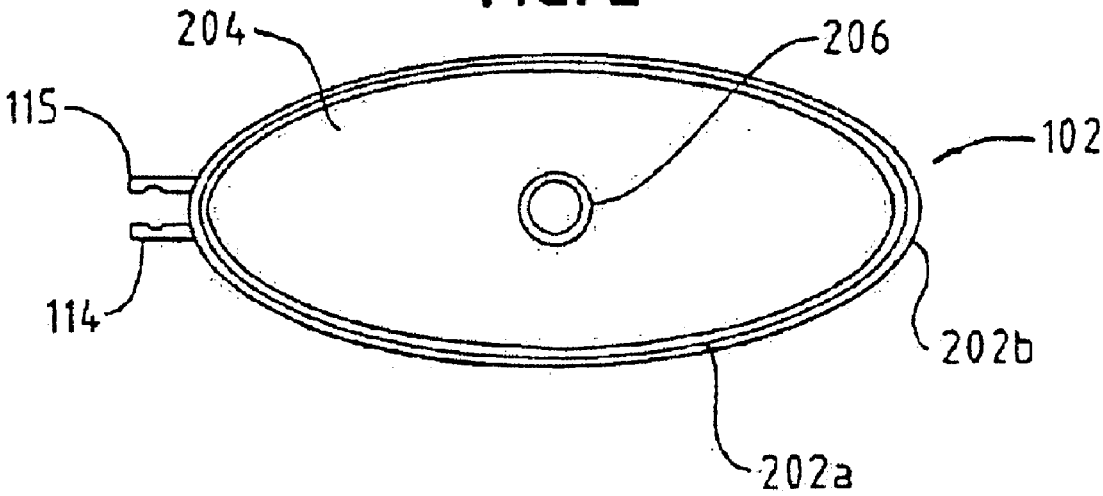
FIG. 2 is top view of a cross-section of an applicator according to a particular embodiment of the present invention.

Turning now to FIG. 2, that Figure provides a look at a cross-section of the sidewalls 102. The sidewalls 102 have an interior surface 202*a* and an exterior surface 202*b*. A movable endwall 204 and a driving shaft 206 are also shown in FIG. 2. The movable endwall 204 and interior surface 202*a* of the sidewalls 102 forms a reservoir for containing a fluid, such as relaxer, within the applicator 100. When more fluid is desired to be pushed from the slot 110, the user may turn the driver 109, which turns the driving shaft 206. The driving shaft 206 is threaded like a screw and drives the movable endwall 204 up and down as the driver 109 is turned. When the driver 109 is turned, the movable endwall 204 thus decreases the size of the reservoir and forces fluid toward the dispensing end 106 and out through the slot 110, preferably onto the subject's hair. While the driver 109 and driving shaft 206 combination is the preferred structure for advancing fluid to and out of the dispensing slot 110, other methods for advancing the fluid may be used. For example, the movable wall 204 may be secured within the inner surface 202*a* using a friction fit or other method. The applicator 100 may also use a pushable button or device, for advancing a movable wall, which is located on the sidewall 102. This arrangement may permit the user to more easily dispense fluid while he or she is applying the fluid. Ultimately, it is desired that the dispensing end 106 include a removable cover to permit replacement of fluid within the applicator 100 when the applicator 100 is empty or low on fluid.

Figure 3:
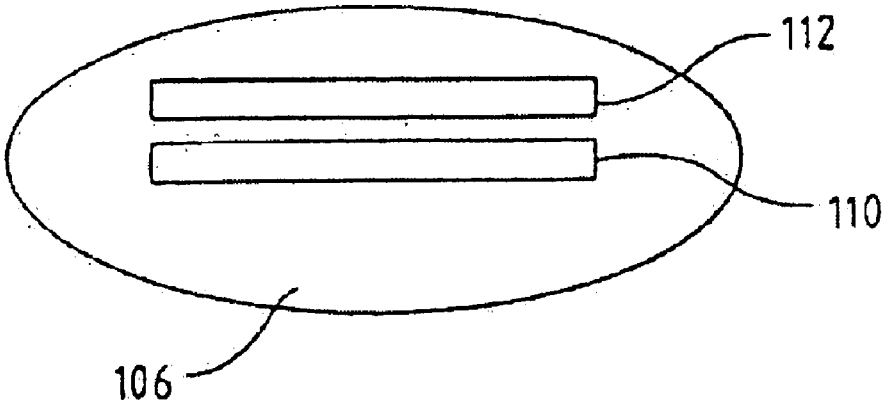
FIG. 3 is a top view of a dispensing end of the applicator according to three alternative embodiments of the invention.
Figure 3A:
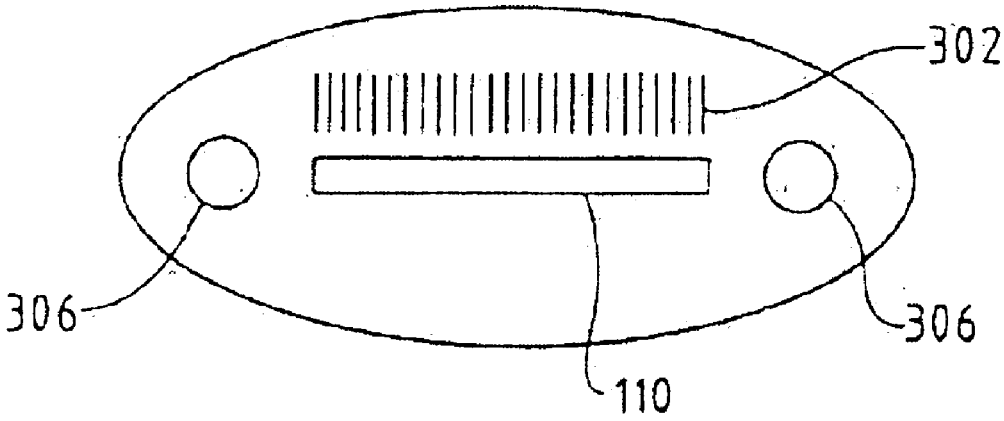
Figure 3B:
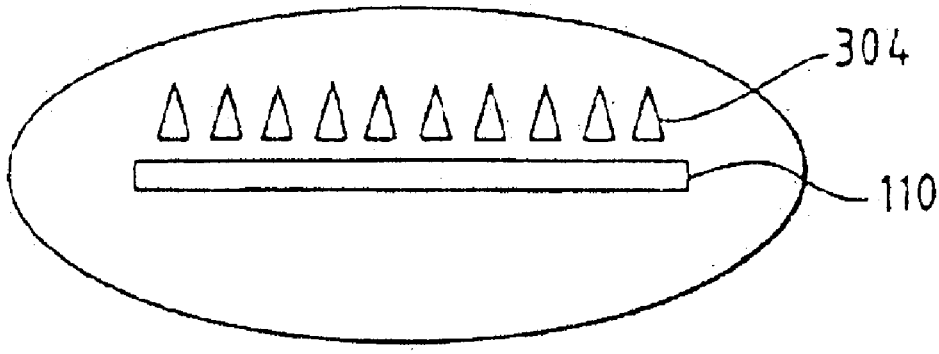
Figure 4:
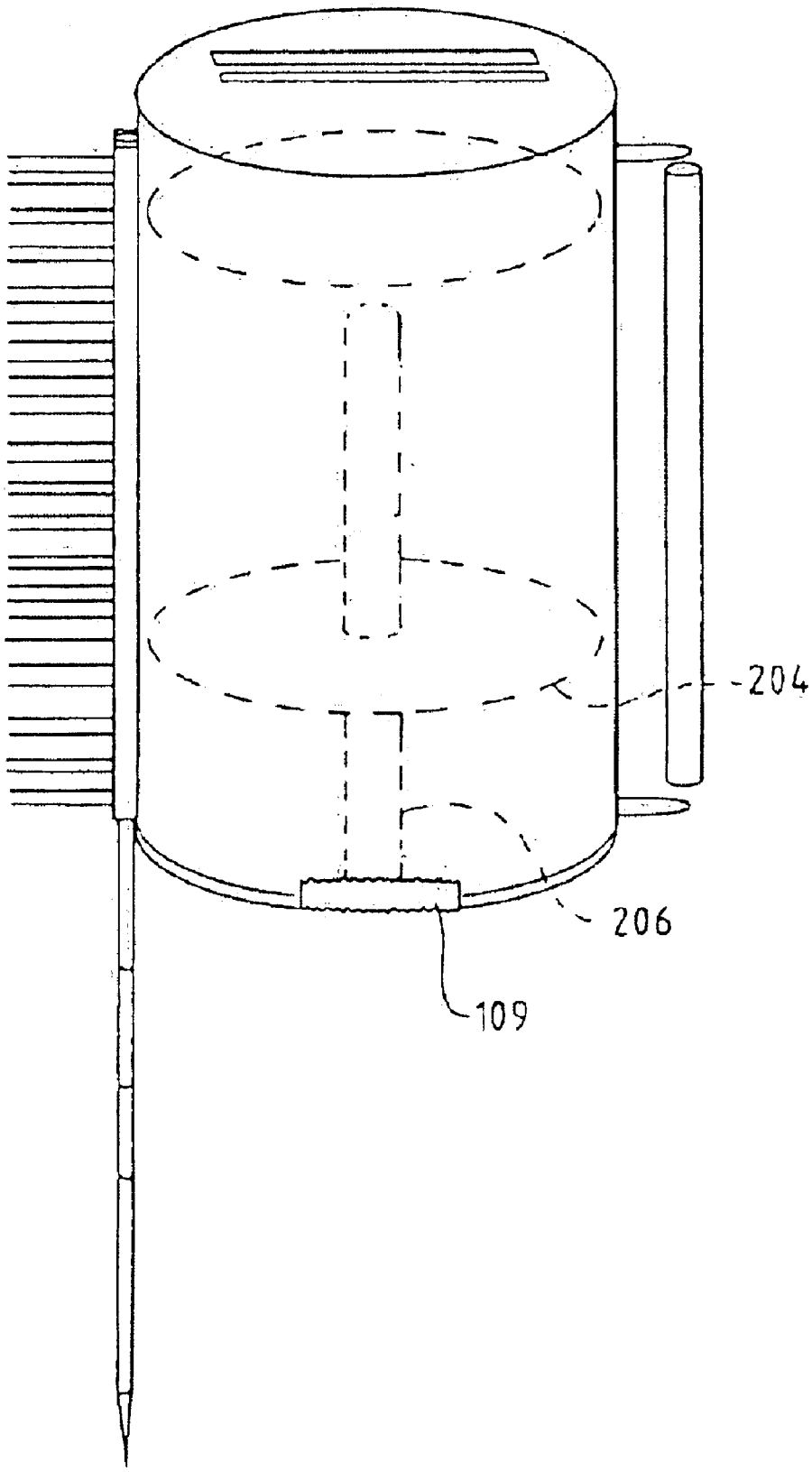
FIG. 4 is a partially exposed side view of an applicator according to a particular embodiment of the invention.

Turning now to FIGS. 3 and 4, FIG. 3 presents a top view of the dispensing end 106, including the elongated dispensing slot 110 and the lip 112. FIG. 4 illustrates the interior of the preferred applicator, including the driver 109, shaft 206 and movable endwall 204. The fluid fills the interior cavity of the applicator 100 and the top surface is shown near the dispensing end 106.

During use, the applicator 100 is preferably tipped upside down, causing the fluid sought to be dispensed onto the hair. After the fluid is placed on the hair, the user may tip the applicator 100 on its side and use the smoothing rod 116 to smooth, spread or apply the fluid evenly (if desired) onto the hair. As a result, depending on how the user holds the applicator 100, he or she may wish to detach the comb 112, collapse the wand 113, or not even have the tracks 114, 115 present on the applicator 100 for easy holding of the applicator 100. Moreover, the fluid is preferably viscous enough such that it does not automatically exit the slot 110 when the applicator 100 is held sideways (so the smoothing rod 116 may be effectively used), but rather is dispensed by the user causing the movable wall 204 to be moved. As a result, depending on the substance the applicator is being used with, the slot may be of a width to prevent dispensation of the fluid without the user causing the endwall 204 to move. In an alternative embodiment, the slot is equipped with a structure (not shown) for varying the width of the slot so that different fluids can be accommodated within the same applicator 100 for different applications. The dispensing end 106 is preferably removable to allow the user to fill the applicator 100 with the desired fluid.

Figure 5:
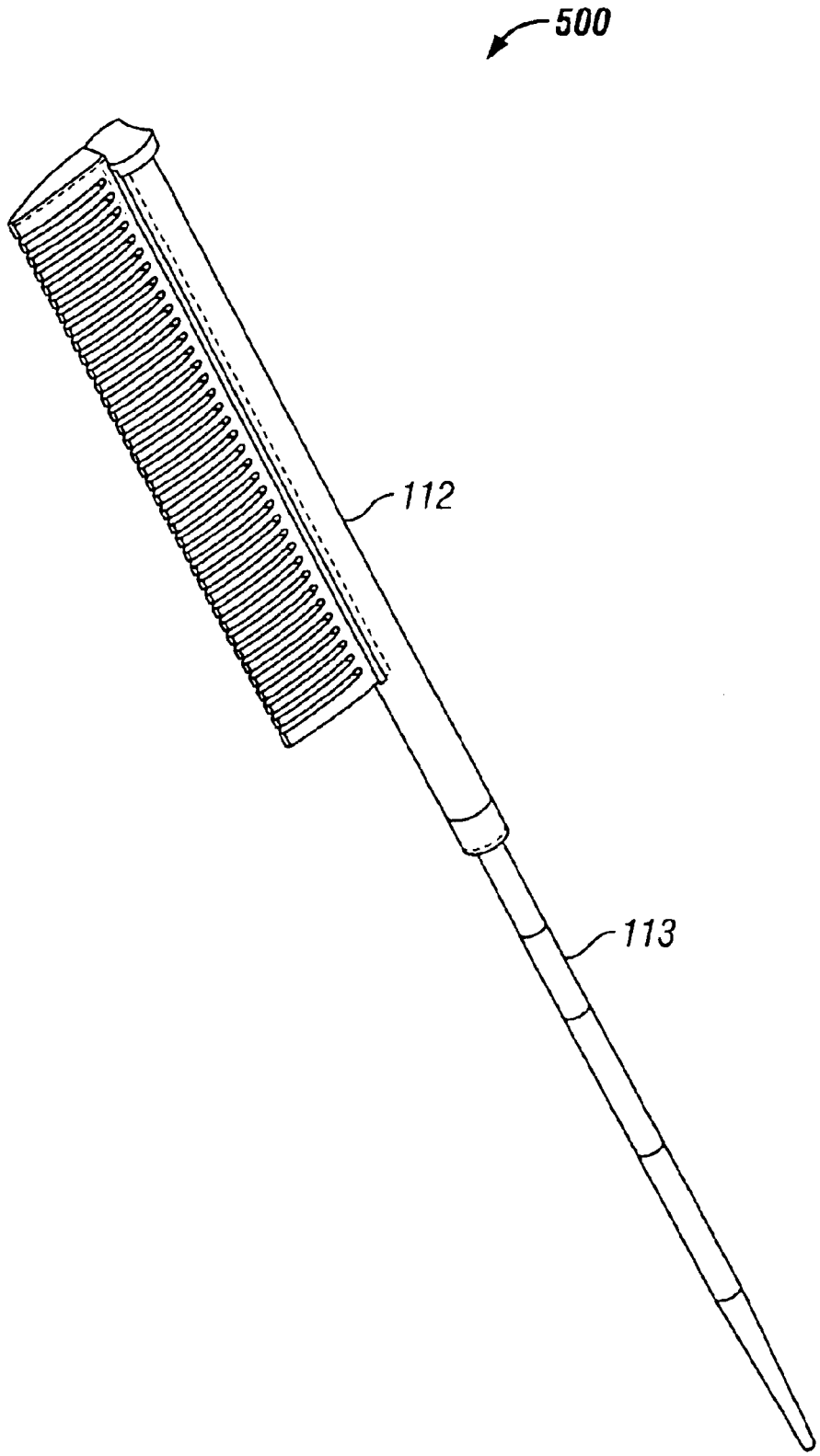
FIG. 5 is a perspective view of a rattail comb according to a particular embodiment of the present invention.
Figure 6:
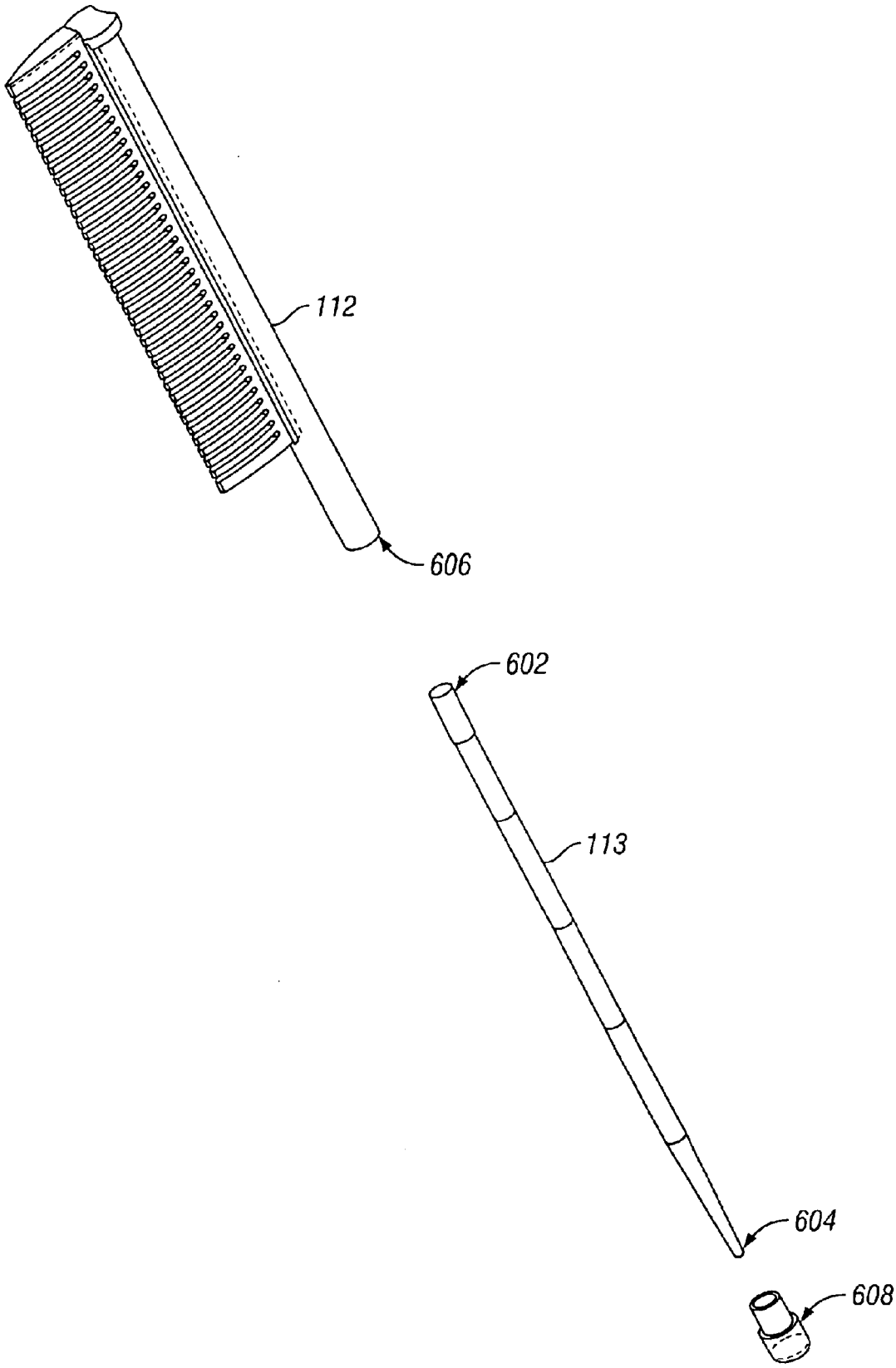
FIG. 6 is a perspective view of a rattail comb according to a particular embodiment of the present invention.

In another alternative embodiment, shown in FIGS. 5 and 6, a telescoping rattail comb 500 is formed from the rattail 113 and comb 112. In this embodiment, because it is detached, the telescoping rattail comb 500 is provided separately from the applicator 100. The telescoping comb 500 may be far more versatile than if it is simply attached to the applicator 100. For example, a hairdresser may use the comb separately to part hair, comb the hair into place using the comb 112, and then use the applicator 100 to apply a fluid to the hair. The comb 500 may also be compactly stored and is easier to clean than if left attached to the applicator 100.

In one embodiment of the telescoping rattail comb 500, illustrated in FIG. 6, the telescoping portion includes a proximal end 602 and a distal end 604, and the comb portion 112 includes a comb attached to a substantially hollow cylinder 606, and the telescoping rattail comb 500 further includes a detachable plug 608 located at the distal end 604 for retaining the telescoping portion 113 within the substantially hollow cylinder 606.

Figure 7:
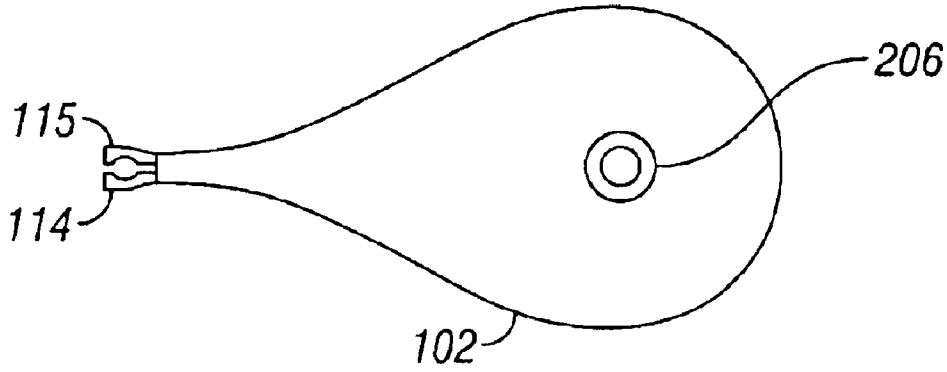
FIG. 7 is a diagrammatical top view of an applicator according to a particular embodiment of the present invention.

In yet another alternative embodiment of the present invention, illustrated in FIG. 7, the body 102 is shaped like a teardrop along the vertical. In this way, the applicator 100 will fit ergonomically within the user's hand, thereby avoiding undue stress or strain to the user and preventing cramping of the user's hand. In particular, the larger curved portion of the sidewalls 102 can be placed closest to the user's palm, while the tapered portion of the sidewalls 102 can be grasped between the user's fingers. In this way, the user can have more control over the applicator 100 than with, for example, an ovular shape. The teardrop shape can also be utilized to provide the user improved visibility to the comb 112, smoothing rod 116, or other structure included along the apex of the teardrop. Improved visibility makes it easier for the user to achieve a better result when using the comb 112, smoothing rod 116, or other structure located at the apex. The teardrop shape can be applied to the entire body 102, or a portion of the body approximately the width of the user's hand. The benefits of the teardrop shape can realized even if it is applied only to the area approximately the width of the user's hand.

Figure 8:
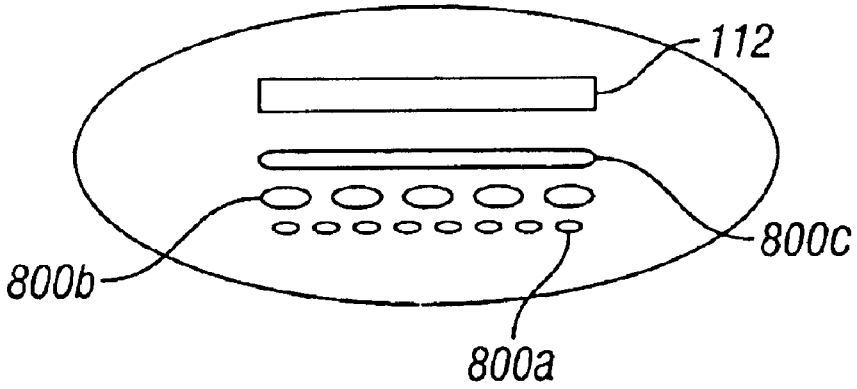
FIG. 8 is a diagrammatical top view of an applicator according to a particular embodiment of the present invention.

In another alternative embodiment, illustrated in FIG. 8, the applicator 100 is equipped with multiple slots, 800*a*, 800*b* and 800*c*. By providing multiple slots, the applicator 100 can be used with more controlled and longer strokes, while avoiding waste. In particular, when the dispensing end 106 is convexly shaped, the single slot 800*c* can be placed at the tallest point of the dispensing end 106. When a fluid is forced toward the slots 800*a–i c*, the fluid will tend to take a path of least resistance, thereby tending initially toward slot 800*c*, with only a smaller portion coming out of slots 800*b* and slots 800*a*. As slot 800*c* lets fluid out, a backup will be created (relative to the time period before no fluid was exiting slot 800*c*) and fluid will move toward slots 800*a–b* with greater force. As a result, the fluid will "back-up," or move to exit slots 800*a–b* as well. Because slots illustrated in FIG. 8 cover an overall smaller surface area as they move away from the pinnacle of the convexly shapped dispensing end 106, they will let lesser amounts of fluid from them as they get further from the pinnacle. In this way, a user can provide more fluid at one time and without the problems of messiness or unnecessary waste provided if the slots were uniform in coverage, a longer, more controlled stroke is possible. As with other embodiments, the dispensing end 106 may be utilizes with a press-fit, screw-on cap, or through other suitable means.

Figure 9:
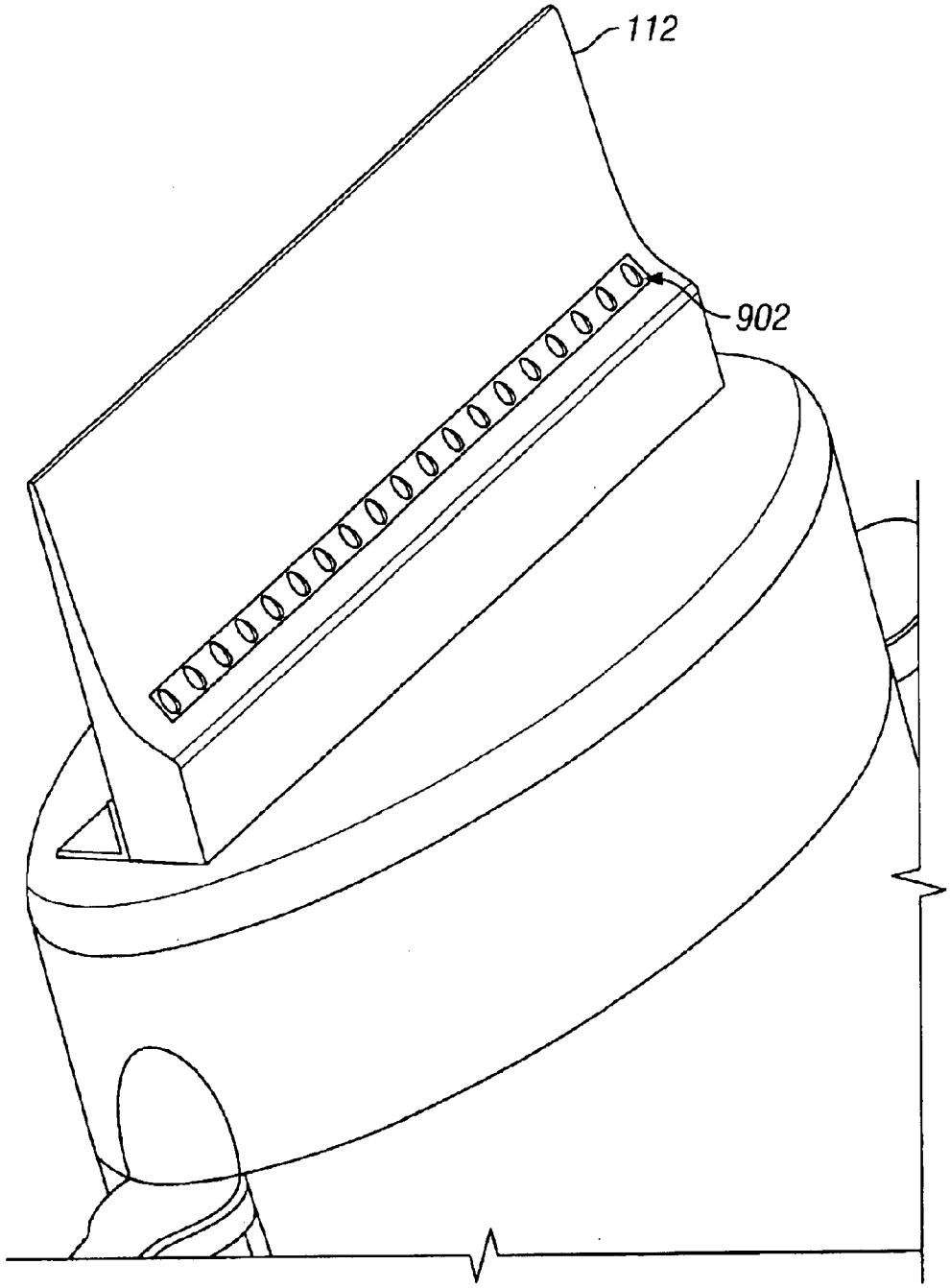
FIG. 9 is a partial perspective view of an applicator according to a particular embodiment of the present invention.
Figure 10:
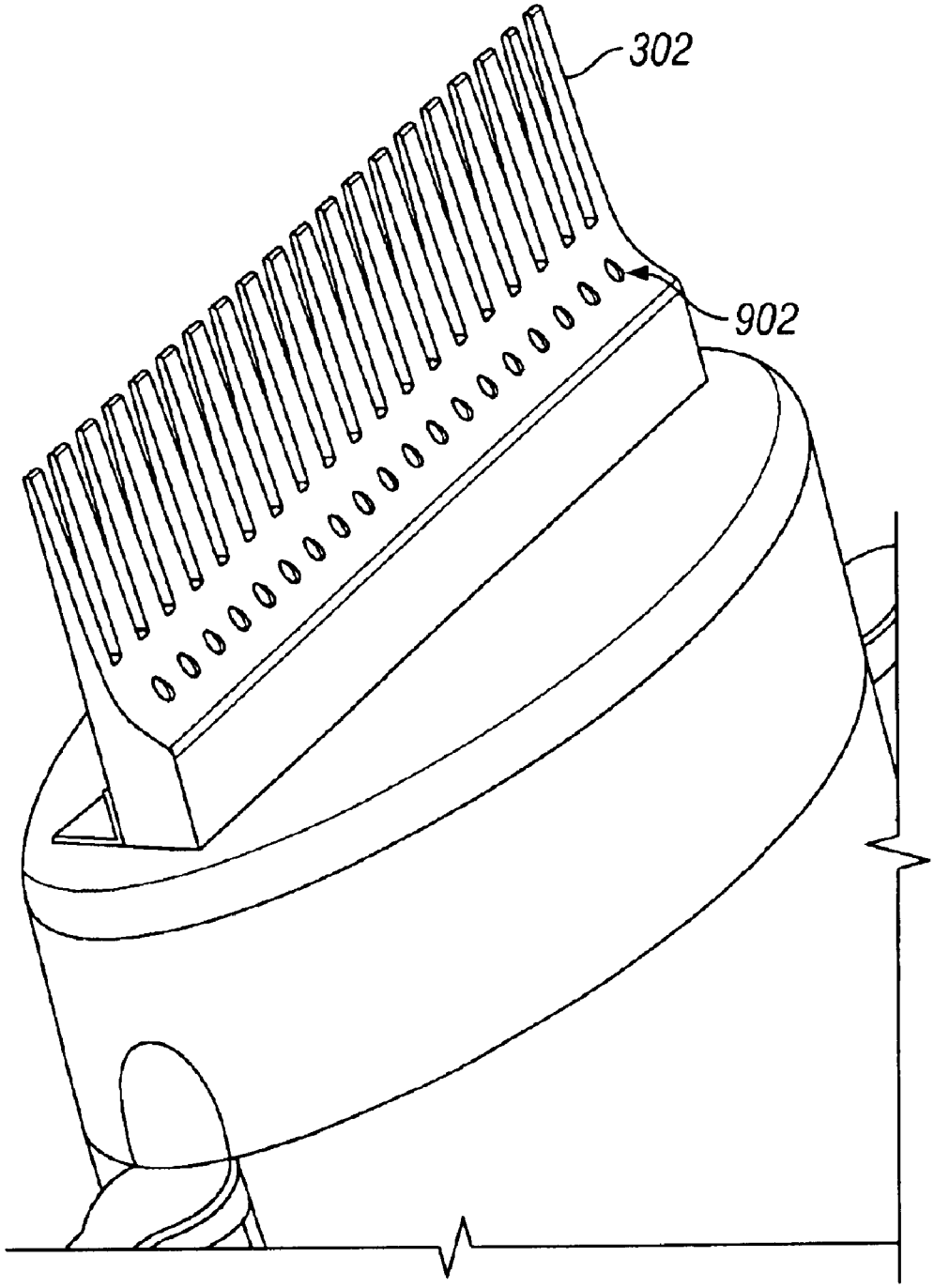
FIG. 10 is a partial perspective view of an applicator according to a particular embodiment of the present invention.

FIGS. 9 and 10 provide alternative embodiments having multiple apertures or cavities for dispensing a fluid. In these Figures, the apertures 902 are provided along the width of the lip 112 and brush or comb bristles 302.

While particular embodiments of the invention have been shown, it will be understood, of course, that the invention is not limited thereto since modifications may be made by those skilled in the art, particularly in light of the foregoing teachings. For example, although a preferred use of the applicator 100 is to apply relaxer to hair, the applicator 100 may also be used for dispensing other substances, for example gel, leave-in conditioner, hair color or bleach to the hair. Additionally, an alternative embodiment includes the elongated slot 110 as a slot in the sidewall 102, adjacent the dispensing end 106 of the applicator. It is, therefore, contemplated by the appended claims to cover any such modifications as incorporate those features which constitute the essential features of these improvements within the true spirit and the scope of the invention.

What is claimed is:

1. An apparatus for parting and combing hair comprising:

a longitudinal axis;

an elongate comb portion extending along the longitudinal axis; and an elongate telescoping portion, adjacent said comb portion, that extends along the longitudinal axis and is telescopically extendable from said comb portion;

wherein said telescoping portion comprises a proximal end, a distal end, and a cross-section perpendicular to said longitudinal axis, said cross-section progressively decreasing in size from said proximal end to said distal end.

2. The apparatus of claim 1 wherein said elongate telescoping portion is detachable from said comb portion.

3. The apparatus of claim 1, wherein said comb portion comprises a comb attached to a substantially hollow cylinder, and further comprising a detachable plug located at the distal end for retaining said telescoping portion within said substantially hollow cylinder.

4. An apparatus for applying a fluid to hair comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis and said sidewalls form a cross-section along the longitudinal axis, said cross-section being teardrop in shape along the longitudinal axis for a substantial portion of their length;

a top endwall located at said top portion of said sidewalls, said endwall comprising an elongate cavity for dispensing a fluid; and a movable bottom endwall for containing said fluid within said reservoir and advancing fluid.

5. The apparatus of claim 4 further comprising structure adjacent said cavity for assistance in applying a fluid dispensing from said elongate cavity to hair.

6. The apparatus of claim 4 wherein said sidewalks form a teardrop shape along the longitudinal axis for substantially their entire length.

7. An apparatus for applying a fluid to hair comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis;

a top endwall located at said top portion of said sidewalls, said endwall comprising a plurality of elongate cavities for dispensing a fluid;

a flexible lip adjacent said cavities for assistance in applying a fluid dispensing from said elongate cavity to hair; and a movable bottom endwall for containing said fluid within said reservoir and advancing fluid.

8. The apparatus of claim 7 wherein said plurality of elongate cavities form a row along a horizontal axis, said horizontal axis being perpendicular to said longitudinal axis.

9. The apparatus of claim 7 wherein said plurality of elongate cavities form a plurality of rows.

10. The apparatus of claim 9 wherein said cavities cover increasing surface areas along the plurality of rows as they move away from said reservoir.

* * * * *